US008217876B2

(12) United States Patent
Hsu et al.

(10) Patent No.: US 8,217,876 B2
(45) Date of Patent: Jul. 10, 2012

(54) LIQUID CRYSTAL DISPLAY FOR REDUCING RESIDUAL IMAGE PHENOMENON

(75) Inventors: Chao-Ching Hsu, Hsin-Chu (TW); Yi-Suei Liao, Hsin-Chu (TW)

(73) Assignee: AU Optronics Corp., Hsin-Chu (TW)

( * ) Notice: Subject to any disclaimer, the term of this patent is extended or adjusted under 35 U.S.C. 154(b) by 1269 days.

(21) Appl. No.: 11/941,606

(22) Filed: Nov. 16, 2007

(65) Prior Publication Data

US 2009/0085855 A1 Apr. 2, 2009

(30) Foreign Application Priority Data

Sep. 28, 2007 (TW) ..... 96136220 A

(51) Int. Cl.
*G09G 3/36* (2006.01)

(52) U.S. Cl. ..... 345/90

(58) Field of Classification Search ..... 345/87–100
See application file for complete search history.

(56) References Cited

U.S. PATENT DOCUMENTS

| | | | | |
|---|---|---|---|---|
| 5,945,970 | A | 8/1999 | Moon et al. | |
| 6,476,590 | B2 | 11/2002 | Chou | |
| 7,209,132 | B2 | 4/2007 | Kida et al. | |
| 2002/0041279 | A1 | 4/2002 | Chou | |
| 2003/0020676 | A1 | 1/2003 | Lin et al. | |
| 2004/0252092 | A1 * | 12/2004 | Roosendaal | 345/87 |

FOREIGN PATENT DOCUMENTS

| | | | |
|---|---|---|---|
| JP | 200678806 | A | 3/2006 |
| JP | 2006078806 | | 3/2006 |
| TW | 519610 | B | 2/2003 |
| TW | 554322 | | 9/2003 |
| TW | 200725536 | | 7/2007 |
| TW | 200725537 | | 7/2007 |

* cited by examiner

*Primary Examiner* — Regina Liang
(74) *Attorney, Agent, or Firm* — Kirton McConkie; Evan R. Witt

(57) ABSTRACT

A liquid crystal display includes a source driver, for generating a pixel data voltage, a gate driver, for generating a scanning signal voltage, and a plurality of pixel units. Each pixel unit includes a switch unit for delivering the pixel data voltage upon receiving the scanning signal voltage, a pixel electrode electrically coupled to the switch unit, a first electrode for supplying a first common voltage, a second electrode for supplying a second common voltage, a liquid crystal capacitor electrically coupled between the first electrode and the pixel electrode for driving liquid crystal layer in response to the pixel data voltage and the first common voltage, and a storage capacitor electrically coupled between the pixel electrode and the second electrode.

1 Claim, 4 Drawing Sheets

LIQUID CRYSTAL DISPLAY FOR REDUCING RESIDUAL IMAGE PHENOMENON

BACKGROUND OF THE INVENTION

1. Field of the Invention

The present invention relates to a liquid crystal display, and more specifically, to a liquid crystal display capable of preventing residual image phenomenon.

2. Description of the Related Art

With a rapid development of monitor types, novel and colorful monitors with high resolution, e.g., liquid crystal displays (LCDs), are indispensable components used in various electronic products such as monitors for notebook computers, personal digital assistants (PDAs), digital cameras, and projectors. The demand for the novelty and colorful monitors has increased tremendously.

Nevertheless, a residual image phenomenon occurs at the moment of shutting down the liquid crystal display because of residual charges are remaining within liquid crystal capacitors. For solving such residual image phenomenon, U.S. Pat. No. 6,476,590 suggests that, upon powering off the LCD, a timing controller generates a specific signal for enabling a source driver to generate a pattern of data signal to the LCD panel, so that the LCD panel may display specific image such as full black or full white image. However, such system architecture will increase the complexity in system design, and further improvements for removing residual image phenomenon are still needed.

SUMMARY OF THE INVENTION

Accordingly, one aspect of the present invention is directed to a liquid crystal display for preventing residual images that substantially obviates one or more of the problems due to limitations and disadvantages of the prior art.

According to the present invention, the liquid crystal display comprises a source driver for generating a pixel data voltage, a gate driver for generating a scanning signal voltage, and a plurality of pixel units. Each pixel unit comprises a switch unit for delivering the pixel data voltage upon receiving the scanning signal voltage, a pixel electrode electrically coupled to the switch unit, a first electrode for supplying a first common voltage, a second electrode for supplying a second common voltage, a liquid crystal capacitor electrically coupled between the first electrode and the pixel electrode for driving liquid crystal layer in response to the pixel data voltage and the first common voltage, and a storage capacitor electrically coupled between the pixel electrode and the second electrode.

In one embodiment of the present invention, the voltage level of the second common voltage is greater than the voltage level of the first common voltage.

In another embodiment of the present invention, the voltage level of the second common voltage is in a range between a maximum voltage level of the pixel data voltage outputted by the source driver and twice of the maximum voltage level of the pixel data voltage.

Another aspect of the present invention is directed to a liquid crystal display. The liquid crystal display comprises a source driver for generating a pixel data voltage, a gate driver for generating a scanning signal voltage, and a plurality of pixel units. Each pixel unit comprises a switch unit for delivering the pixel data voltage upon receiving the scanning signal voltage, a pixel electrode electrically coupled to the switch unit, a first electrode for supplying a first common voltage, a second electrode for supplying a second common voltage, a liquid crystal capacitor electrically coupled between the first electrode and the pixel electrode for driving liquid crystal layer in response to the pixel data voltage and the first common voltage, a first storage capacitor electrically coupled between the pixel electrode and the first electrode, and a second storage capacitor electrically coupled between the pixel electrode and the second electrode.

In one embodiment of the present invention, the voltage level of the second common voltage is greater than the voltage level of the first common voltage.

These and other objectives of the present invention will become apparent to those of ordinary skill in the art after reading the following detailed description of the preferred embodiments illustrated in the various figures and drawings.

DETAILED DESCRIPTION OF THE INVENTION

Figure 1:
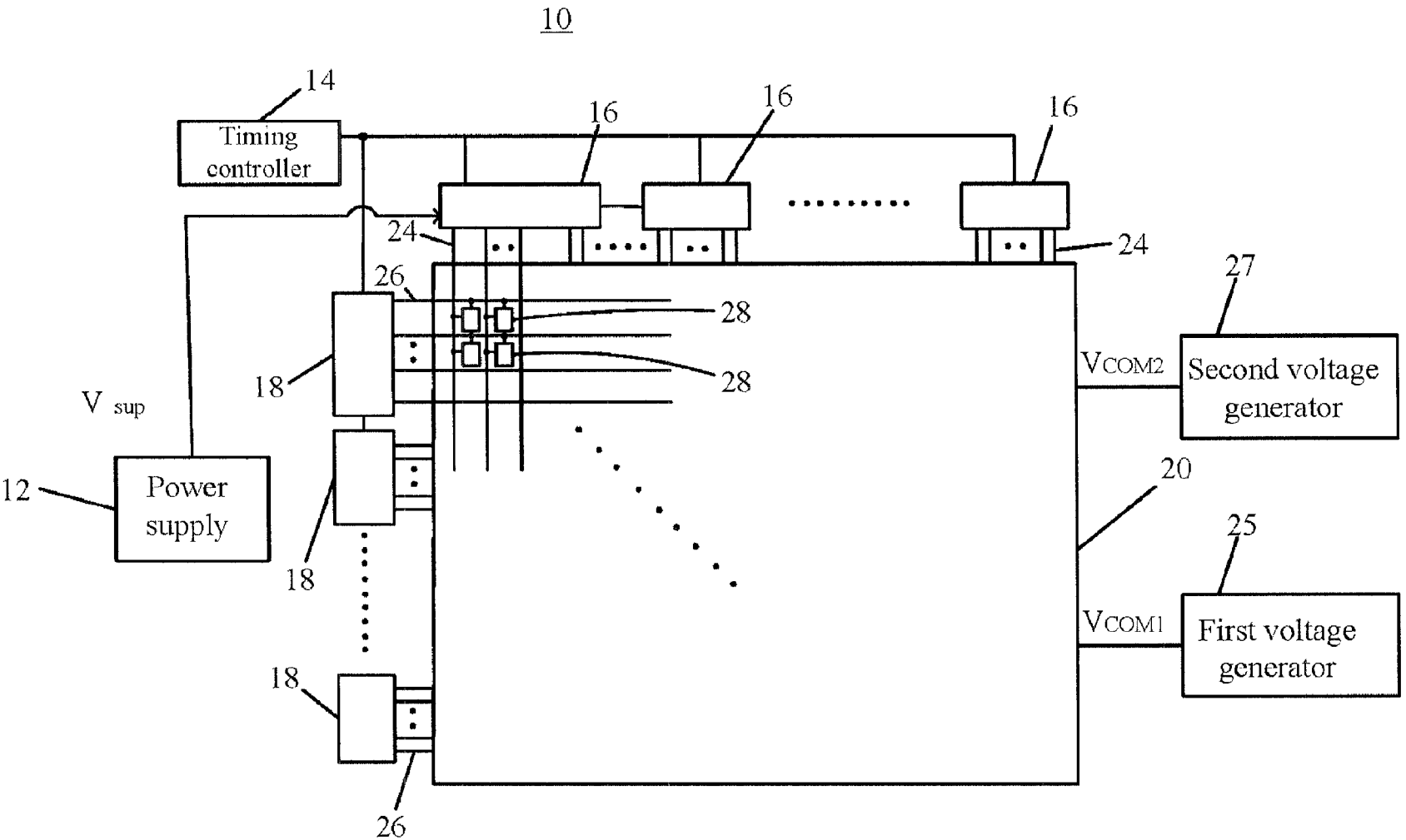
FIG. 1 shows a block diagram of the liquid crystal display of the present invention.

FIG. 1 illustrates a block diagram of the liquid crystal display according to the present invention. The liquid crystal display (LCD) 10 comprises a power supply 12, a timing controller 14, a plurality of source drivers 16, a plurality of gate drivers 18, a first voltage generator 25, a second voltage generator 27, and an LCD panel 20. The LCD panel 20 comprises a plurality of pixel units 28. The power supply 12 is used for supplying required operating power Vsup to the timing controller 14, the plurality of source drivers 16, and the plurality of gate source drivers 18. For clarity, only connections between the power supply 12 and the plurality of source drivers 16 are shown.

Upon receiving clock signal from the timing controller 14, the plurality of gate drivers 18 generate scan signal to the liquid crystal panel 20 via the scan lines 26. Meanwhile, the plurality of source drivers 16 delivers data signal to the liquid crystal panel 20 via the data lines 24, in response to the clock signal from the timing controller 14. As a result, the pixel units 28 show an image based on the data signal in response to the scan signal. The first voltage generator 25 is used for supplying a first common voltage $V_{COM1}$, and the second voltage generator 27 is used for supplying a second common voltage $V_{COM2}$. A voltage level of the second common voltage $V_{COM2}$ is higher than that of the first common voltage $V_{COM1}$.

Figure 2:
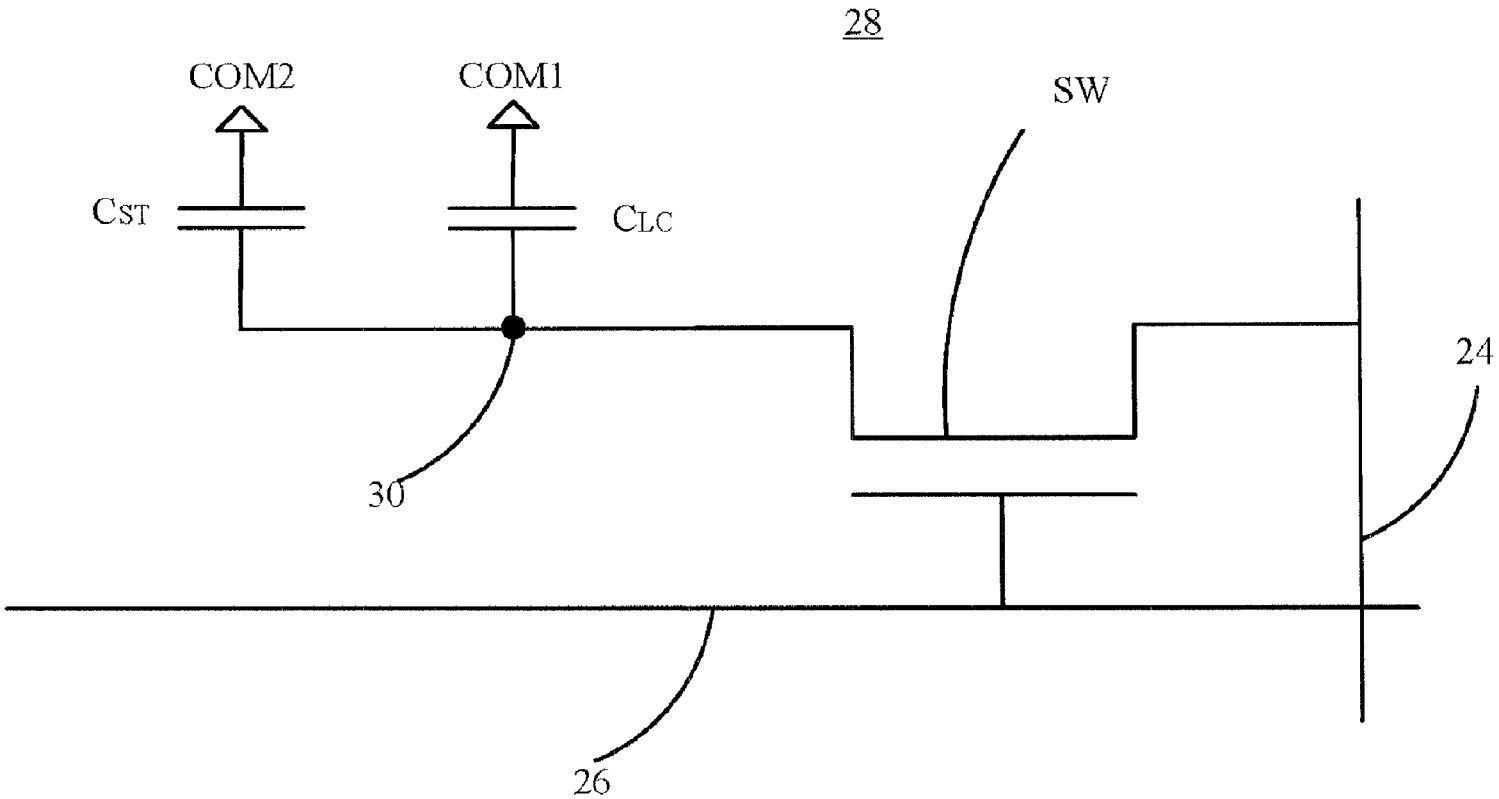
FIG. 2 shows an equivalent circuit diagram of the pixel unit according to a first embodiment of the present invention

FIG. 2 shows an equivalent circuit diagram of the pixel unit according to a first embodiment of the present invention. The plurality of gate line 26 and the plurality of data line 24 are crisscross in a grid line formation. Each pixel unit 28 comprises a storage capacitor $C_{ST}$ and a liquid crystal capacitor $C_{LC}$ having two electrodes and a crystal layer sandwiched therebetween. One electrode of the liquid crystal capacitor $C_{LC}$ couples to a pixel electrode 30 so as to link to a switch unit SW (which may be implemented by a thin film transistor), and the other electrode couples to the first electrode COM1. The storage capacitor $C_{ST}$ is coupled between the switch unit SW and the second electrode COM2. The first electrode COM1 couples to the first voltage generator 25 to provide the first common voltage $V_{COM1}$, and the second electrode COM2 couples to the second voltage generator 27 to provide the second common voltage $V_{COM2}$.

Figure 3B:
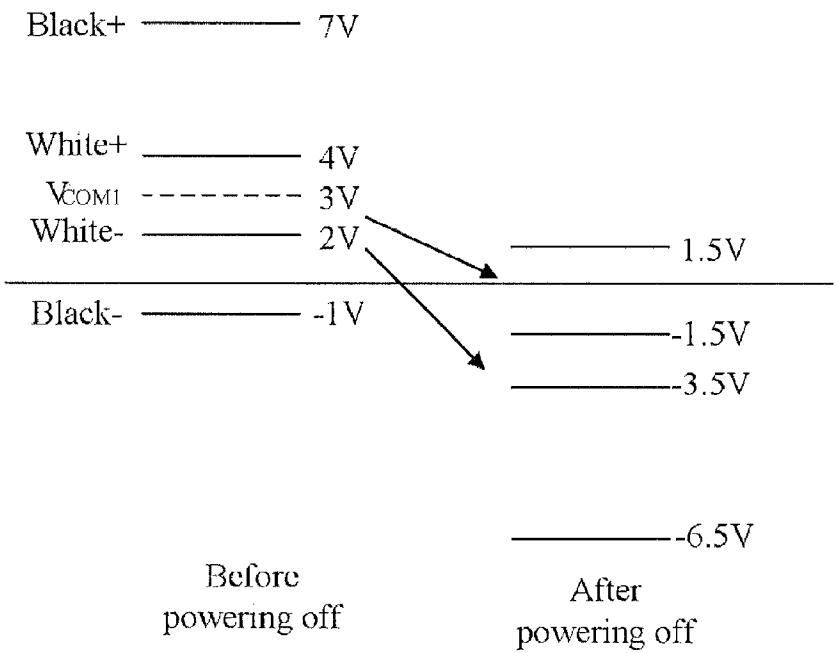
FIG. 3B shows variations in voltage level on the pixel electrode in reference to the first common voltage $V_{COM1}$ of 3V and the second common voltage $V_{COM2}$ of 8.5V, before and after the LCD is shut down.
Figure 3A:
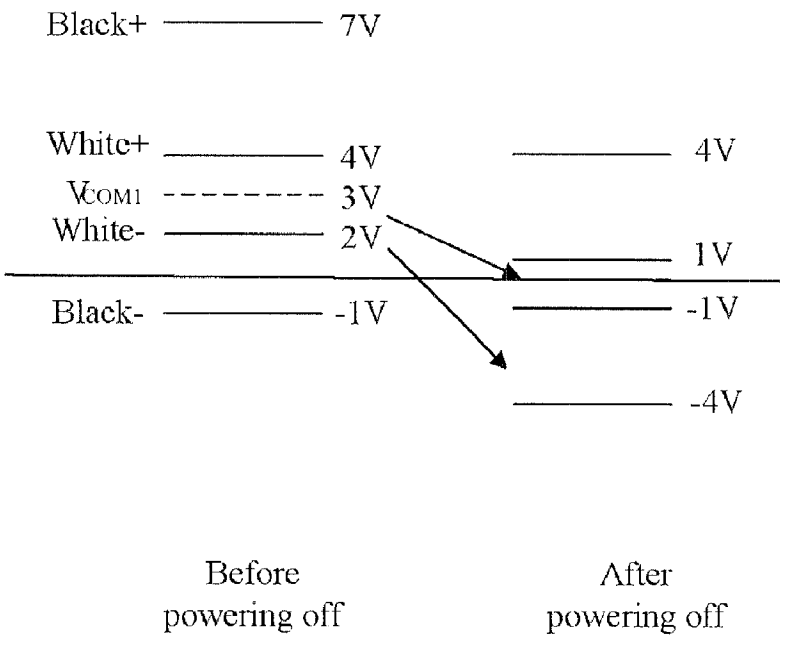
FIG. 3A shows variations in voltage level on the pixel electrode in reference to the first common voltage $V_{COM1}$ of 3 V and the second common voltage $V_{COM2}$ of 3V, before and after the LCD is shut down.

With reference to FIG. 3A and FIG. 3B, FIG. 3A shows variations in voltage level on the pixel electrode in reference to the first common voltage $V_{COM1}$ of 3V and the second common voltage $V_{COM2}$ of 3V, before and after the LCD is shut down, and FIG. 3B shows variations in voltage level on the pixel electrode in reference to the first common voltage $V_{COM1}$ of 3V and the second common voltage $V_{COM2}$ of 8.5V, before and after the LCD is shut down. The residual image phenomenon occurs in a moment of shutting down the LCD, due to charge stored in the liquid crystal capacitor $C_{LC}$ which fails to rapidly flow out on account of slight leakage current through the switch unit SW. This means that the voltage level on the pixel electrode does not drop to 0V at the moment of shutdown the LCD. As shown in FIG. 3A, after powering off, transients of the first common voltage $V_{COM1}$ supplied by the first electrode COM1 from 3V to 0V and the second common voltage $V_{COM2}$ supplied by the second electrode COM2 from 3V to 0V induces a maximum voltage level Vmax on the pixel electrode 30 to 4V due in large part to capacitor-coupling effect. Assuming that a drop of the voltage level on the pixel electrode 30 is from 4V to 0V, discharging with the leakage current through the switch unit SW is 10 seconds, i.e. the time period of residual image phenomenon is 10 seconds. Preferably, as shown in FIG. 3B associated with the exemplary embodiment, after powering off, transients of the first common voltage VCOM1 supplied by the first electrode COM1 is from 3V to 0V, and the second common voltage $V_{COM2}$ supplied by the second electrode COM2 is from 8.5V to 0V, which induces a maximum voltage level Vmax on the pixel electrode 30 to be 1.5V due to capacitor-coupling effect. In contrast, a drop of the voltage level on the pixel electrode 30 is from 1.5V to 0V, discharging with the leakage current through the switch unit SW is only 1 second, i.e. the time period of residual image phenomenon is shortened to 1 second. In conclusion, according to the embodiment, the maximum voltage level on the pixel electrode 30 converges to 0V on the moment of powering off the LCD, shortening the discharge period of the liquid crystal capacitor, thereby reducing residual image phenomenon.

In the moment of powering off the LCD, a voltage drop on the pixel electrode 30 is given by $(C_{ST}\times V_{COM2}+C_{LC}\times V_{COM1})/(C_{ST}+C_{LC})$. Accordingly, the voltage drop on the pixel electrode 30 complies with the maximum voltage level Vmax of the pixel data voltage is preferred. That is $(C_{ST}\times V_{COM2}+C_{LC}\times V_{COM1})/(C_{ST}+C_{LC})=Vmax$, and then

133

$$V_{COM2}=(Vmax\times(C_{ST}+C_{LC})-C_{LC}\times V_{COM1})/C_{ST}.$$

For example, if Vmax=7V, $V_{COM1}$=3V, $C_{ST}$:$C_{LC}$=1:1, the optimal second common voltage $V_{COM2}$ is 11 V, so as to meet the criteria that the voltage drop on the pixel electrode 30 complies with the maximum voltage level Vmax of the pixel data voltage. Although the present invention has been explained by the embodiments shown in the drawings described above, it should be understood to persons of ordinary skill in the art that the invention is not limited to the embodiments. For example, voltage level of the second common voltage of $V_{COM2}$ is greater than that of the first common voltage $V_{COM1}$ is also in the scope of the present invention. Depending on the design demand, $C_{ST}/C_{LC}$=0.5~2 and $V_{COM2}$ in a range between Vmax ~2×Vmax are optimal.

Figure 4:
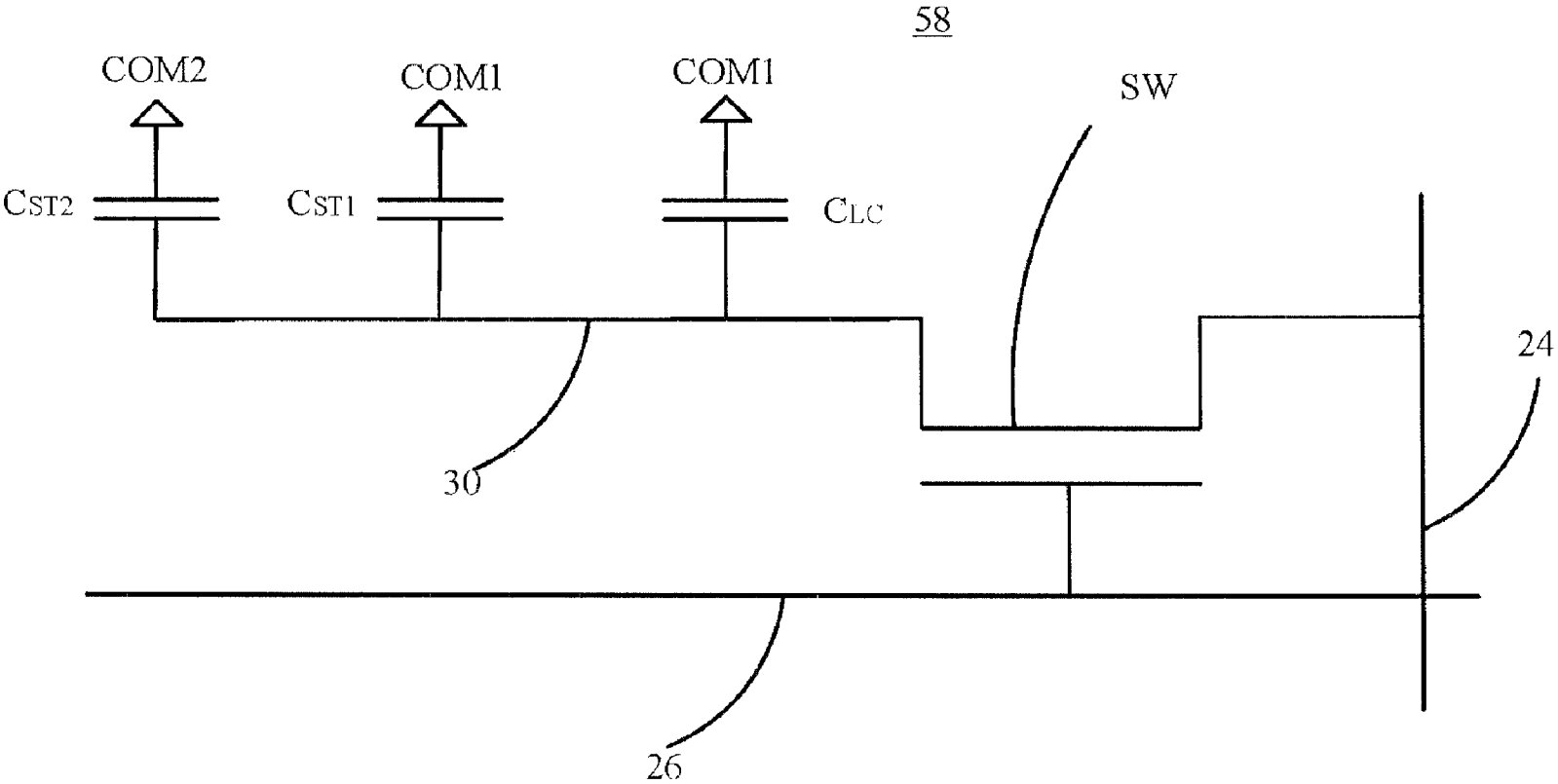
FIG. 4 shows an equivalent circuit diagram of the pixel unit according to a second embodiment of the present invention.

FIG. 4 shows an equivalent circuit diagram of the pixel unit according to a second embodiment of the present invention. The plurality of gate lines 26 and the plurality of data lines 24 are crisscross in a grid line formation. Each pixel unit 58 comprises a first storage capacitor $C_{ST1}$, a second storage capacitor $C_{ST2}$, and a liquid crystal capacitor $C_{LC}$ having two electrodes and a crystal layer sandwiched therebetween. One electrode of the liquid crystal capacitor $C_{LC}$ couples to a pixel electrode 30, so as to link to a switch unit SW (which may be implemented by a thin film transistor), and the other electrode couples to a first electrode COM1. The first storage capacitor $C_{ST1}$ is coupled between the switch unit SW and the first electrode COM1. The second storage capacitor $C_{ST2}$ is coupled between the switch unit SW and the second electrode COM2. The first electrode COM1 couples to the first voltage generator 25 to provide the first common voltage $V_{COM1}$, and the second electrode COM2 couples to the second voltage generator 27 to provide the second common voltage $V_{COM2}$.

In the moment of powering off the LCD, a voltage drop on the pixel electrode 30 is given by $(C_{ST2}\times V_{COM2}+(C_{ST1}+C_{LC})\times V_{COM1})/(C_{ST1}+C_{ST2}+C_{LC})$. Accordingly, the voltage drop on the pixel electrode 30 complies with the maximum voltage level Vmax is preferred. That is $(C_{ST2}\times V_{COM2}+(C_{ST1}+C_{LC})\times V_{COM1})/(C_{ST1}+C_{ST2}+C_{LC})=Vmax$, and then $$V_{COM2}=(Vmax\times(C_{ST1}+C_{ST2}+C_{LC})-(C_{ST1}+C_{LC})\times V_{COM1})/C_{ST2}.$$

For example, if Vmax=7V, $V_{COM1}$=3V, $C_{ST1}$:$C_{ST2}$:$C_{LC}$=1:1:1, the optimal second common voltage $V_{COM2}$ is 15V, so as to meet the criteria that the voltage drop on the pixel electrode 30 complies with the maximum voltage level Vmax. Although the present invention has been explained by the embodiments shown in the drawings described above, it should be understood to the ordinary skilled person in the art that the invention is not limited to the embodiments. For example, voltage level of the second common voltage of $V_{COM2}$ is greater than that of the first common voltage $V_{COM1}$, which is also in the scope of the present invention. As such, the capacitance of the second storage capacitor $C_{ST2}$ is less than one-third of the whole capacitance of $(C_{ST1}+C_{ST2}+C_{LC})$, so the second common voltage $V_{COM2}$ amounts to the maximum voltage level supplied by the gate driver is optimal.

In contrast to prior art, the present invention provides a crystal capacitor coupled to a first common voltage and a storage capacitor coupled to a second common voltage of which a voltage level is greater than that of the first common voltage. Consequently, the voltage level of the pixel voltage drops to a lower voltage level after powering off the LCD, thereby shortening a discharge period of the liquid crystal capacitor and improving residual image phenomenon.

While the present invention has been described in connection with what are considered to be preferred embodiments, it is understood that this invention is not limited to the disclosed embodiments but is intended to cover various arrangements made without departing from the scope of the broadest interpretation of the append claims.

What is claimed is:

1. A liquid crystal display, comprising:

a source driver for generating a pixel data voltage;

a gate driver for generating a scanning signal voltage; and a plurality of pixel units, each comprising:

a switch unit for delivering the pixel data voltage upon receiving the scanning signal voltage;

a pixel electrode electrically coupled to the switch unit;

a first electrode for supplying a first common voltage;

a second electrode for supplying a second common voltage;

a liquid crystal capacitor, electrically coupled between the first electrode and the pixel electrode, for driving liquid crystal layer in response to the pixel data voltage and the first common voltage;

a first storage capacitor electrically coupled between the pixel electrode and the first electrode; and a second storage capacitor electrically coupled between the pixel electrode and the second electrode, wherein the voltage level of the second common voltage is greater than the voltage level of the first common voltage.

* * * * *